US011095065B2

(12) United States Patent
Chang

(10) Patent No.: US 11,095,065 B2
(45) Date of Patent: Aug. 17, 2021

(54) COMBINATION STRUCTURE OF SOCKET OF POWER SUPPLY DEVICE

(71) Applicant: Chicony Power Technology Co., Ltd., New Taipei (TW)

(72) Inventor: Chih-Yuan Chang, New Taipei (TW)

(73) Assignee: CHICONY POWER TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/932,703

(22) Filed: Jul. 18, 2020

(65) Prior Publication Data

US 2021/0226373 A1 Jul. 22, 2021

(30) Foreign Application Priority Data

Jan. 17, 2020 (TW) ..... 109101716

(51) Int. Cl.
*H01R 13/44* (2006.01)
*H01R 13/453* (2006.01)
*H01R 13/631* (2006.01)

(52) U.S. Cl.
CPC ..... *H01R 13/4534* (2013.01); *H01R 13/6315* (2013.01)

(58) Field of Classification Search
USPC ..... 439/137, 731, 465, 687, 906, 696, 695
See application file for complete search history.

(56) References Cited

U.S. PATENT DOCUMENTS 5,703,754 A * 12/1997 Hinze ..... B60R 16/0239 361/736
6,162,092 A 12/2000 Lin
6,309,257 B1 * 10/2001 Huang ..... H05K 5/061 174/50.5
6,881,069 B2 * 4/2005 Chen ..... H01R 39/64 362/647
7,109,413 B2 * 9/2006 Chen ..... H01R 13/533 174/17 VA
8,029,308 B2 10/2011 Saruwatari
(Continued)

FOREIGN PATENT DOCUMENTS

CN 236580 Y 2/2000
CN 201018157 Y 2/2008
(Continued)

OTHER PUBLICATIONS

Office Action dated May 20, 2021 of the corresponding Taiwan patent application No. 109101716.

*Primary Examiner* — Harshad C Patel
(74) *Attorney, Agent, or Firm* — Chun-Ming Shih; HDLS IPR Services

(57) ABSTRACT

A power supply device includes a housing having a socket opening, and a pair of sliding grooves are formed on the socket opening. A guiding piece is formed at a bottom of each sliding groove, and the guiding piece includes a positioning section and a guiding section. A power socket passes through the sliding grooves along the guiding section, and one side of the power socket is abutted against the positioning section so as to contact the socket opening. A cover plate is provided with a pair of clips corresponding to the sliding grooves, and the clips are inserted into the pair of sliding grooves and abutted against a side of the power socket for positioning the power socket.

10 Claims, 9 Drawing Sheets

(56) References Cited

U.S. PATENT DOCUMENTS

| | | | | |
|---|---|---|---|---|
| 8,162,701 | B2 * | 4/2012 | Lee | H01R 13/745 439/731 |
| 9,306,313 | B2 * | 4/2016 | Heggemann | H01R 13/5202 |
| 9,306,341 | B2 * | 4/2016 | Wang | H01R 13/665 |
| 9,363,343 | B2 * | 6/2016 | Rao | H04B 1/3888 |
| 9,825,415 | B1 * | 11/2017 | Lin | H01R 13/506 |
| 9,942,996 | B2 * | 4/2018 | Kojima | H05K 5/03 |
| 10,178,782 | B2 * | 1/2019 | Gunes | H05K 5/0069 |
| 10,201,071 | B1 * | 2/2019 | Lin | H01R 12/00 |
| 2005/0042904 | A1 | 2/2005 | Chen | |
| 2015/0131354 | A1 * | 5/2015 | Nakajima | H02M 7/003 363/144 |

FOREIGN PATENT DOCUMENTS

| | | | |
|---|---|---|---|
| CN | 101997227 | B | 12/2012 |
| CN | 203300868 | U | 11/2013 |
| CN | 203645013 | U | 6/2014 |
| CN | 206992418 | U | 2/2018 |
| CN | 108173055 | B | 6/2019 |
| TW | 412079 | U | 11/2000 |
| TW | M567499 | U | 9/2018 |
| WO | 2014166300 | A1 | 10/2014 |

* cited by examiner

COMBINATION STRUCTURE OF SOCKET OF POWER SUPPLY DEVICE

BACKGROUND OF THE INVENTION

Field of the Invention

The present invention generally relates to a power supply device and, in particular to a combination structure of a socket of a power supply device.

Description of Prior Art

A power supply device usually comprises an upper and a lower housings combined with each other, and a circuit board module and electrical components etc. are disposed in the upper and lower housings. In addition, an AC power which inputs the power supply device through a power input terminal is converted into a DC power, and then the DC power will output from a power output terminal to electronic products that require power.

Moreover, in the structure of the power supply device, the power output terminal is configured by disposing a socket opening in the lower housing and combining a power socket therein. In addition, the combination structure of the power socket is to bring the power socket in the lower housing firstly, and then the power socket will be assembled in the socket opening. Besides, the power socket is held from the top to the bottom by clips. At last, the upper housing is combined with the lower housing to clamp and fix the power socket.

However, the assembly of the power socket aforementioned is cumbersome and the assembly time is long and does not meet the requirement. In addition, the power socket is easily to be scratched during the process of positioning, and that will affect the overall appearance.

In view of the above drawbacks, the inventor proposes the present invention based on his expert knowledge and elaborate researches in order to solve the problems of prior art mentioned above, which is the research motivation of the inventor.

SUMMARY OF THE INVENTION

Accordingly, an object of the present invention is to provide a combination structure of a socket of a power supply device, wherein the clips of the cover plate are correspondingly inserted into the pair of sliding grooves and abutted against the power socket; thus the power socket is clamped between the cover plate and the housing without moving for positioning.

Accordingly, an object of the present invention is to provide a combination structure of a socket of a power supply device, wherein the power socket passes through the pair of sliding grooves along the guiding section of the guiding piece, and the power socket is abutted against the positioning section so as to contact the socket opening; thereby, the power socket can be prevented from scratching to keep a good overall appearance.

In order to achieve the objects mentioned above, the present invention provides a combination structure of a socket of a power supply device comprising a housing, a power socket and a cover plate. The housing has an accommodation space and a socket opening communicated with the accommodation space. The housing is formed with a pair of sliding grooves on two sides of the socket opening. Besides, a guiding piece is formed at a bottom of each of sliding grooves, and the guiding piece includes a positioning section connected with the housing and a guiding section extended from the positioning section. In addition, a power socket passes through the pair of sliding grooves along the guiding section in the accommodation space, and one side of the power socket is abutted against the positioning section so as to contact the socket opening. Furthermore, a cover plate is provided with a pair of clips on a side facing the housing corresponding to the sliding grooves. The pair of clips are correspondingly inserted into the pair of sliding grooves and abutted against a side of the power socket.

Comparing to the prior art, the housing of the combination structure of the socket of the power supply device is formed with a pair of sliding grooves on two sides of the socket opening, and a guiding piece is formed at a bottom of each sliding groove. The guiding piece includes a positioning section connected with the housing and a guiding section extended from the positioning section. Thus, the power socket passes through the pair of sliding grooves along the guiding section and is abutted against the positioning section so as to contact the socket opening. Thereby, the power socket can be prevented from scratching to keep a good overall appearance. Furthermore, the cover plate is provided with clips, and the clips are inserted into the pair of sliding grooves correspondingly to abut against the power socket. Therefore, the power socket is clamped between the cover plate and the housing without moving for positioning, and the practicality of the invention is enhanced.

BRIEF DESCRIPTION OF DRAWINGS

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE PREFERRED EMBODIMENTS

In cooperation with attached drawings, the technical contents and detailed description of the invention are described thereinafter according to a number of preferable embodiments, being not used to limit its executing scope. Any equivalent variation and modification made according to appended claims is all covered by the claims claimed by the present invention.

Figure 1:
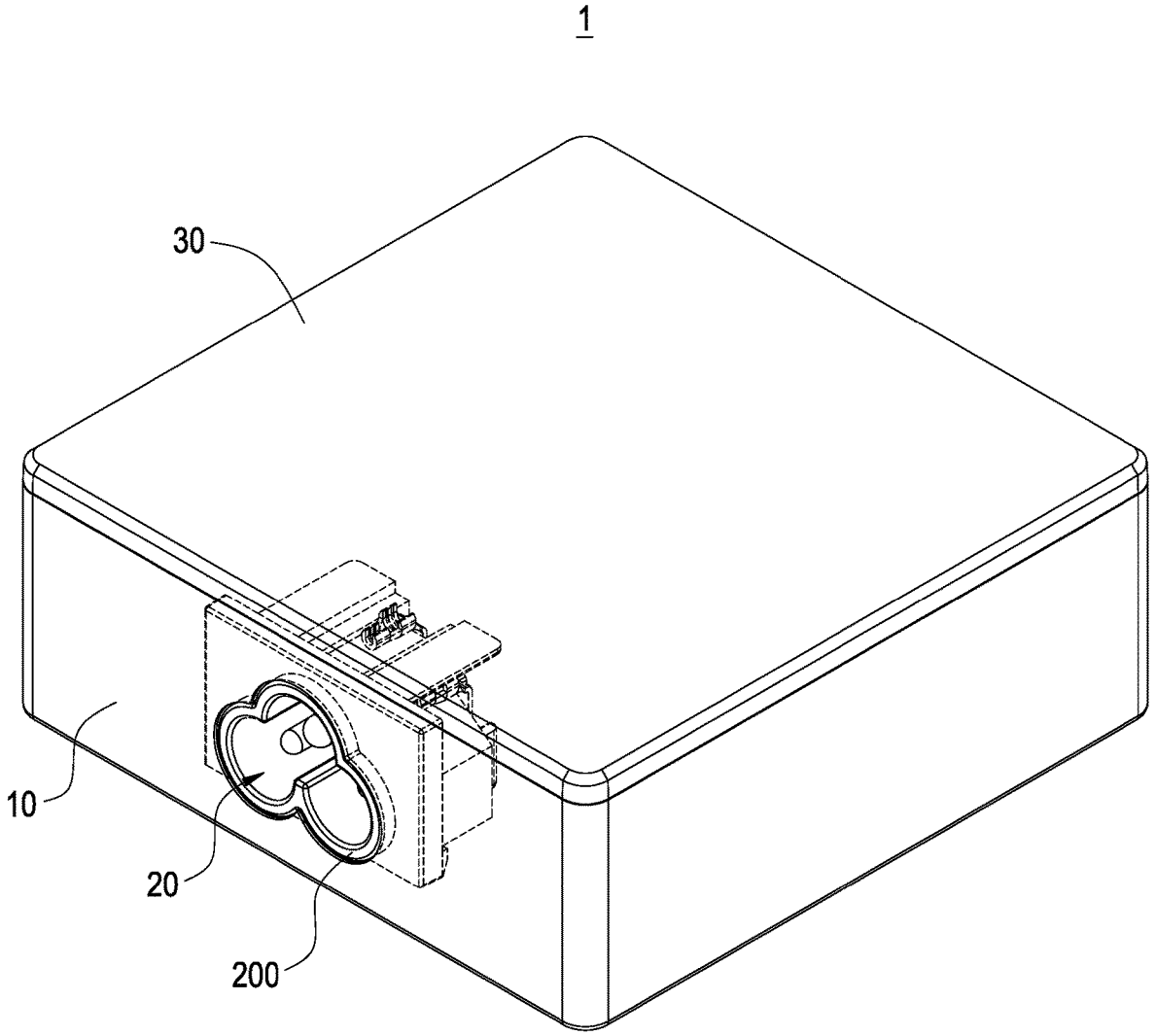
FIG. 1 is a perspective schematic view of the combination structure of socket of power supply device of the present invention.
Figure 2:
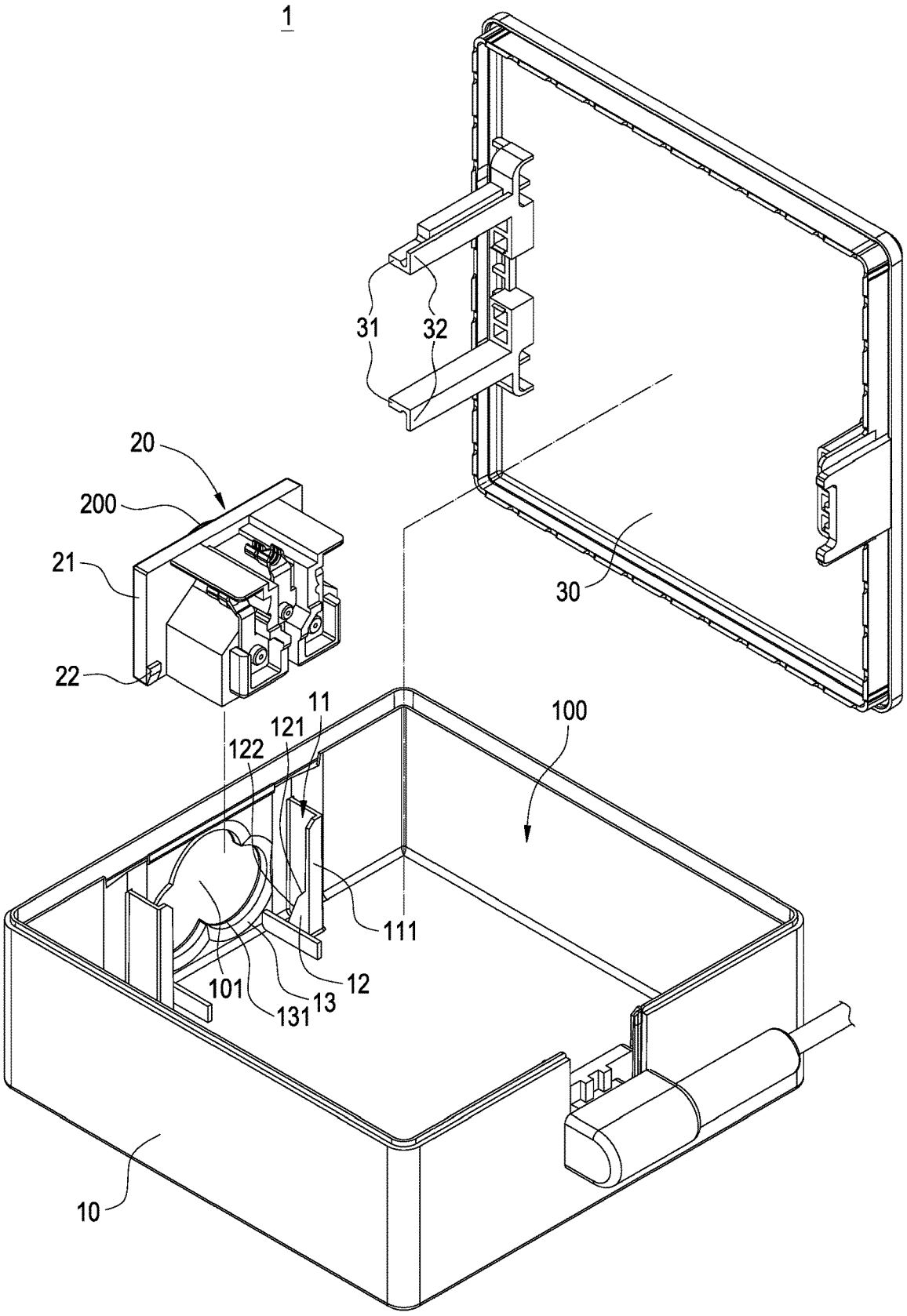
FIG. 2 is a perspective explosion schematic view of the combination structure of socket of power supply device of the present invention.
Figure 3:
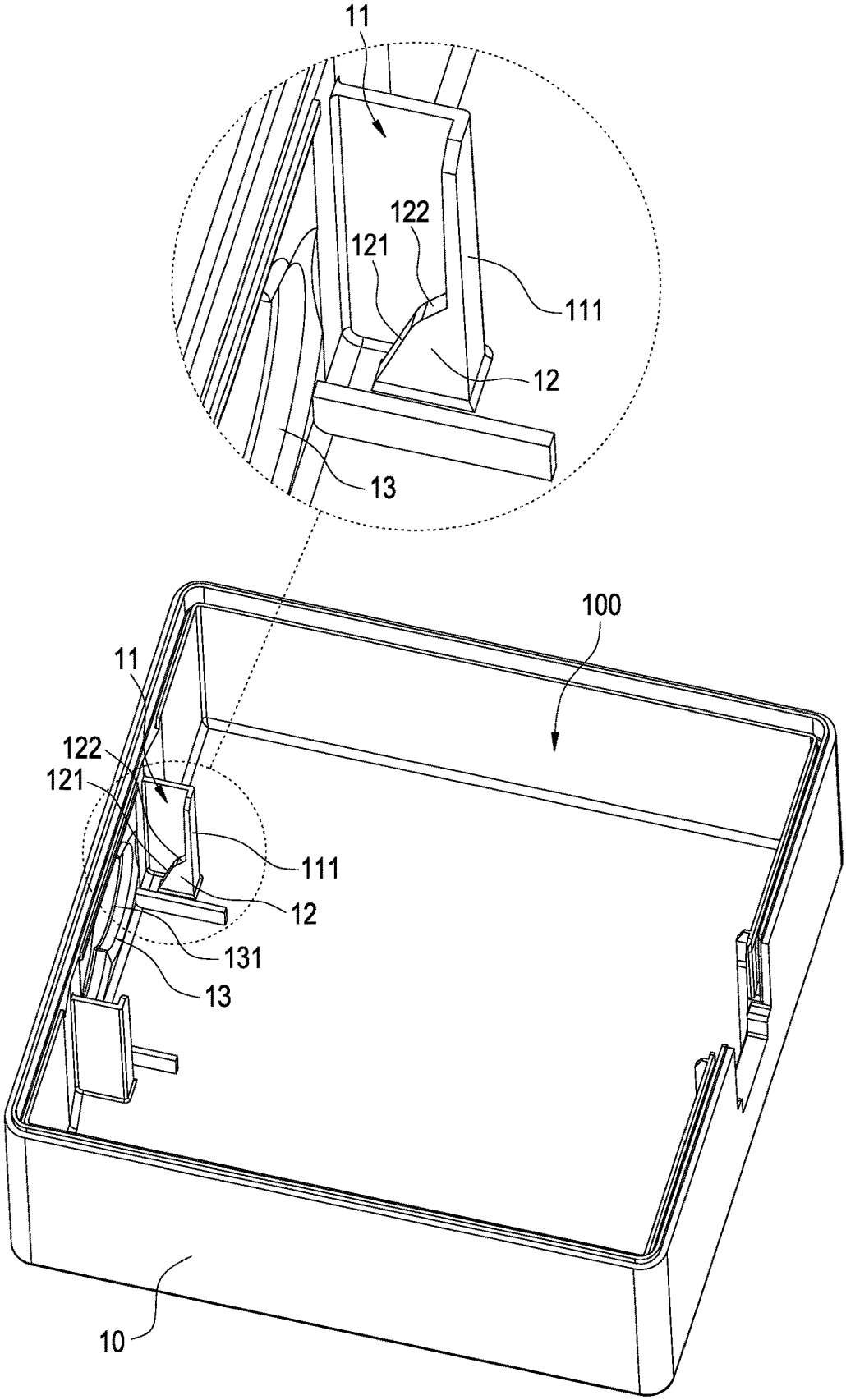
FIG. 3 is a partial enlarged schematic view of the housing of the present invention.

Please refer to FIG. 1 to FIG. 3, which depict a perspective schematic view of the combination structure of socket of power supply device of the present invention, a perspective explosion schematic view of the combination structure of socket of power supply device of the present invention, and a partial enlarged schematic view of the housing of the present invention. The present invention is a combination structure 1 of socket of power supply device including a housing 10, a power socket 20 and a cover plate 30. The power socket 20 is combined in an opening at one side of the housing 10 as a power output terminal, and the cover plate 30 combines with the housing 10 and covers the power socket 20. Thereby, the power socket 20 is sandwiched and fixed between the housing 10 and the cover plate 30 to constitute a combination structure 1 of socket of power supply device.

The housing 10 has an accommodation space 100 and a socket opening 101 communicated with the accommodation space 100. The housing 10 is formed with a pair of sliding grooves 11 on two sides of the socket opening 101, and a guiding piece 12 is formed at a bottom of each of the sliding grooves 11. The guiding piece 12 includes a positioning section 121 connected with the housing 10 and a guiding section 122 extended from the positioning section 121.

It is worthy of noticing that in the present embodiment, the housing 10 has a flange 13 on an inner peripheral edge of the socket opening 101, and the flange 13 is formed with a guiding slope 131 so that the thickness of the flange 13 becomes thinner from the inner peripheral edge of the socket opening 101 outwardly.

The power socket 20 passes through the pair of sliding grooves 11 along the guiding section 122 of the guiding piece 12 in the accommodation space 100, and one side of the power socket 20 is abutted against the positioning section 121 so as to contact the socket opening 101. Moreover, the power socket 20 has a socketing surface 200 exposed the socket opening 101.

In one embodiment of the present invention, the power socket 20 has a front plate 21, and the front plate 21 is provided with a guiding block 22 on a side facing the accommodation space 100 corresponding to each of the guiding pieces 12. Preferably, the guiding block 22 is located at a bottom side of the front plate 21. In addition, each of the sliding grooves 11 is an L-shaped groove and a stopper plate 111 is formed on a side away from the socket opening 101. Besides, the guiding piece 12 is connected with the stopper plate 111 and located at a bottom of the stopper plate 111. Specifically, the guiding pieces 12 is vertically connected to one side of the stopper plate 111.

Furthermore, the cover plate 30 is combined with the housing 10. The cover plate 30 is provided with a pair of clips 31 on a side facing the housing 10 corresponding to the sliding grooves 11, and the pair of clips 31 are disposed for fixing the power socket 20. In addition, the cover plate 30 is provided with a supporting plate 32 on a side of each clip 31. Preferably, the clip 31 and the supporting plate 32 are connected and configured in an L shape.

Figure 4:
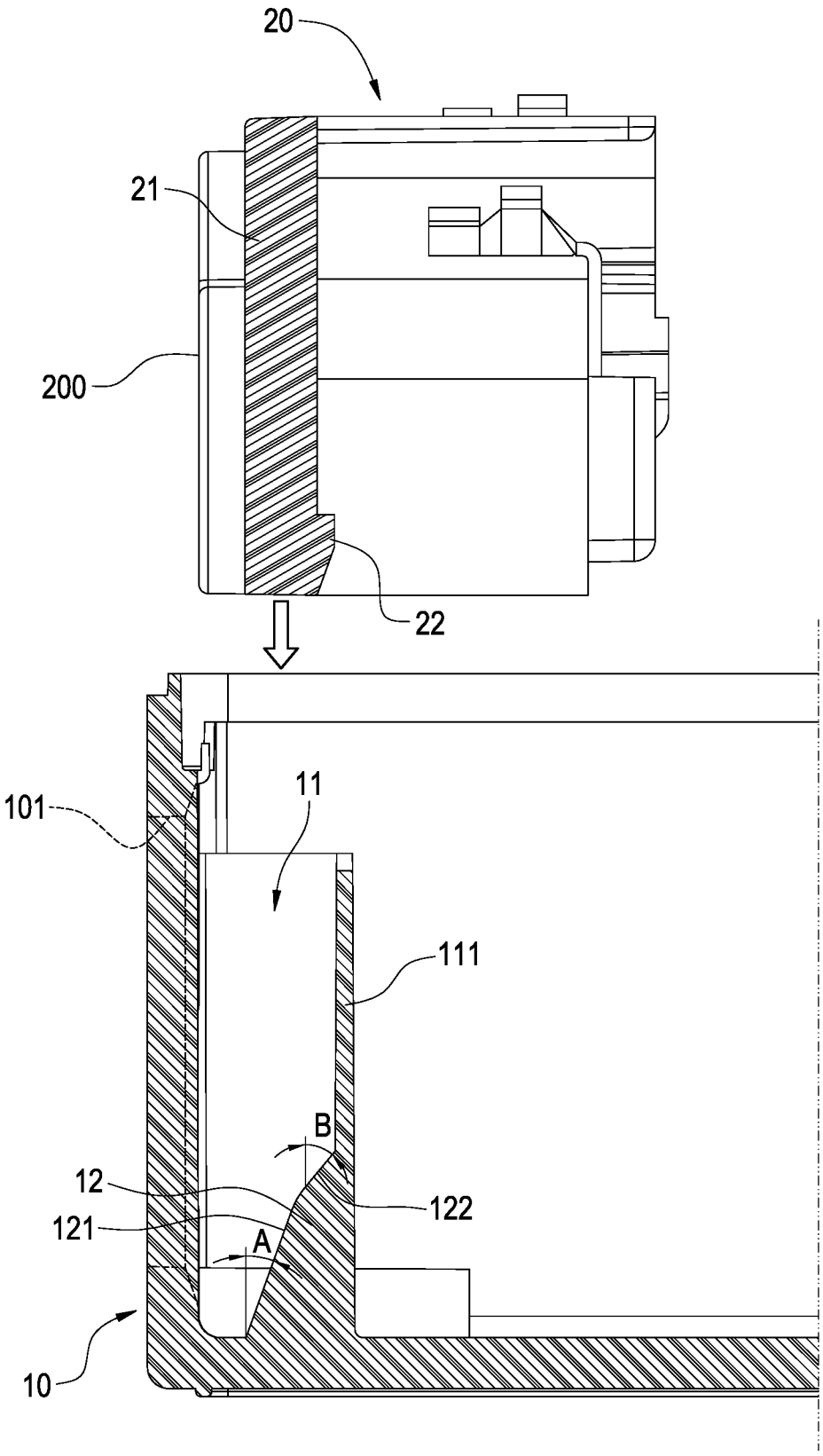
FIG. 4 to FIG. 6 are operation schematic views of the power socket inserting the housing of the present invention.
Figure 5:
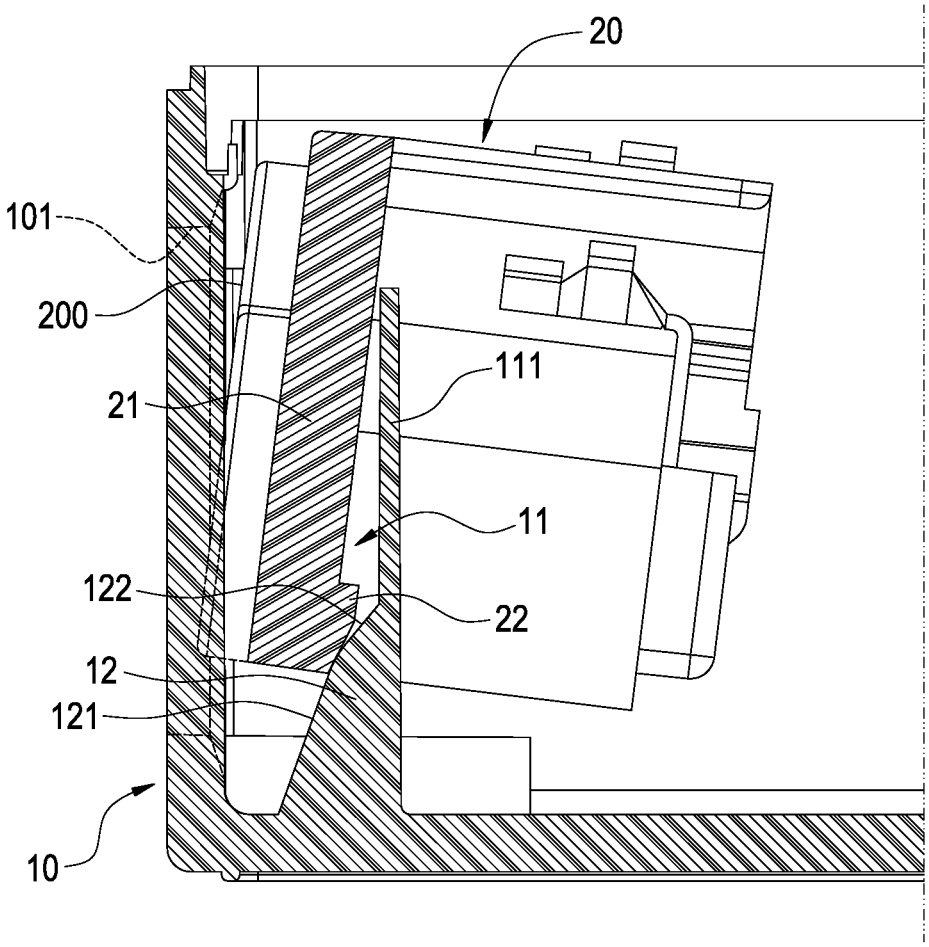
Figure 6:
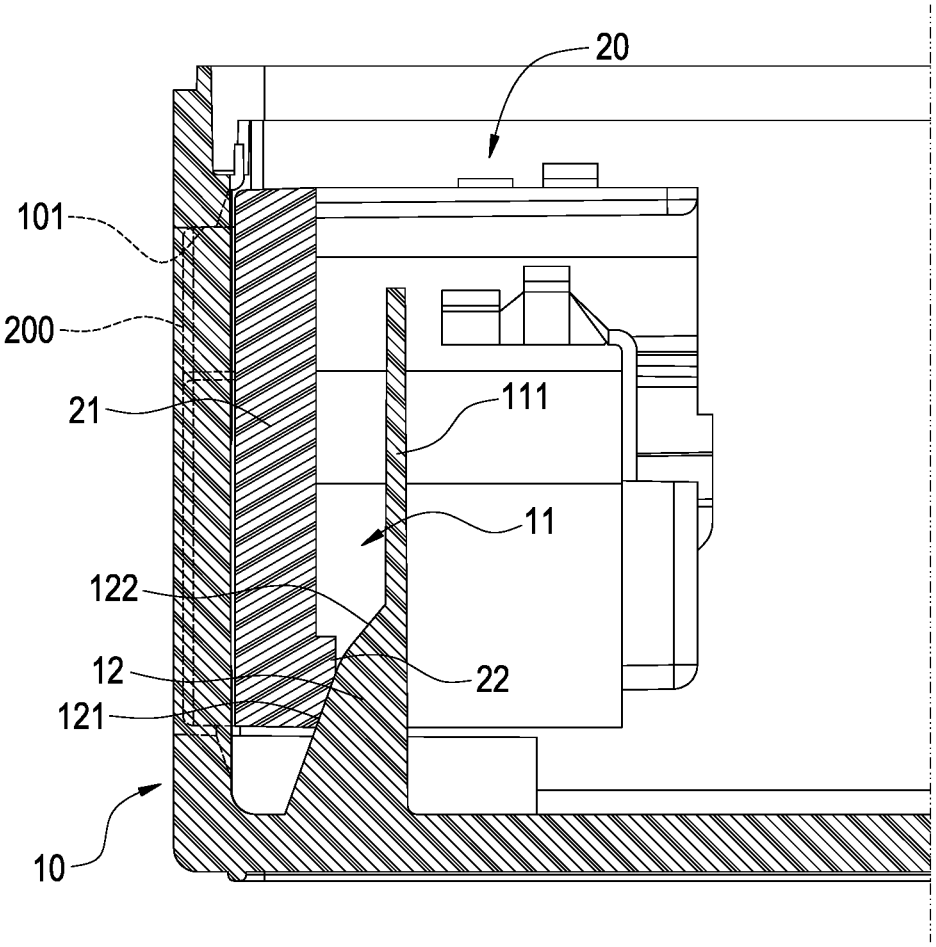

Please further refer to FIG. 4 to FIG. 6, which are operation schematic views of the power socket inserting the housing of the present invention. When the power socket 20 of the present invention is assembled into the housing 10, firstly the power socket 20 is brought close to the socket opening 101, and then the front plate 21 of the power socket 20 is inserted into the sliding grooves 11. At last, the guiding block 22 of the power socket 20 slides into the sliding grooves 11 along the guiding piece 12 and abuts on the positioning section 121.

Please refer to FIG. 4. The positioning section 121 and the guiding section 122 of the present invention have different slopes. Specifically, the positioning section 121 and a normal of a bottom surface of the housing 10 have a positioning oblique angle A formed therebetween; besides, the guiding section 122 and the normal of the bottom surface of the housing 10 have a guiding oblique angle B formed therebetween, wherein the guiding oblique angle B is greater than the positioning oblique angle A. In other words, the slope of the guiding section 122 is smaller than that of the positioning section 121.

Please also refer to FIG. 5. During the assembly process of the power socket 20 of the present invention, when the guiding block 22 abuts against the guiding section 122 of the guiding piece 12 and inserts into the sliding grooves 11, the guiding section 122 has a large slope so that the power socket 20 is tilted away from the socket opening 101. Therefore, the socketing surface 200 of the power socket 20 is separated from the socket opening 101 by a distance in order to prevent the socketing surface 200 from being scratched by the housing 10 and to keep a good appearance.

Furthermore, with referring the FIG. 6, the guiding block 22 of the power socket 20 passes through the guiding section 122 to insert the sliding groove 11 and then is abutted on the positioning section 121. At the time, because the positioning section 121 has a small slope, the power socket 20 will gradually approach the socket opening 101 until the bottom end of the power socket 20 is abutted on the positioning section 121. Accordingly, the power socket 20 is mounted on the housing 10.

Figure 7:
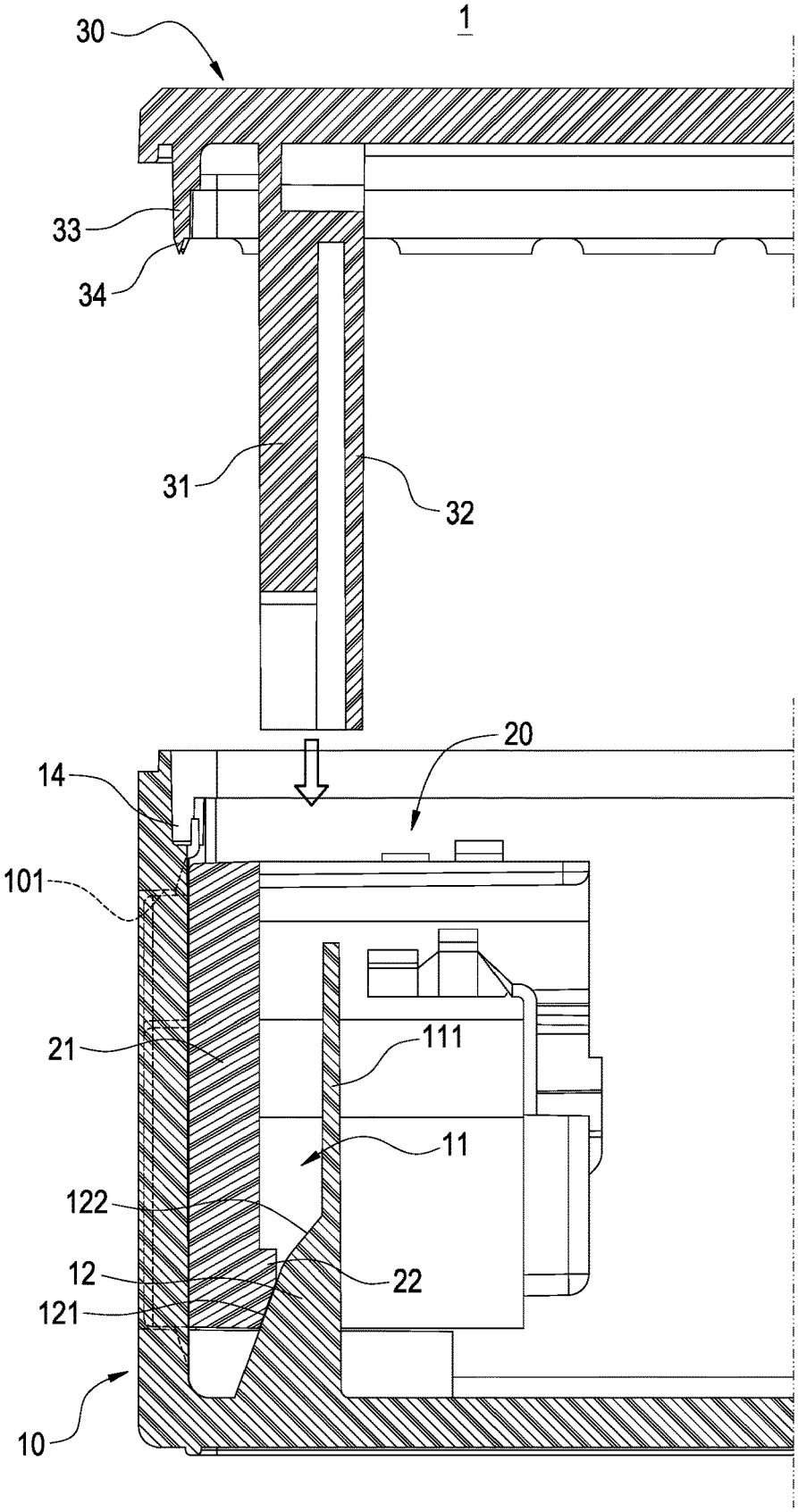
FIG. 7 is a combination schematic view of the cover plate and the housing of the present invention.

Please also refer to FIG. 7, which depicts a combination schematic view of the cover plate and the housing of the present invention. As shown in the figure, after the power socket 20 is assembled into the housing 10, the cover plate 30 will combine with the housing 10 at last to complete the combination structure 1 of socket of power supply device.

In the present embodiment, the cover plate 30 and the housing 10 are combined by ultrasonic welding. Specifically, the cover plate 30 has a combination wall 33, and a bump 34 is formed at an end of the combination wall 33. On the other hand, a groove 14 is provided on a top of the housing 10. In real practice, the combination wall 33 of the cover plate 30 is inserted into the groove 14 of the housing 10 to perform an ultrasonic welding. At last, the cover plate 30 and the housing 10 are bonded through melting the bump 34.

Figure 8:
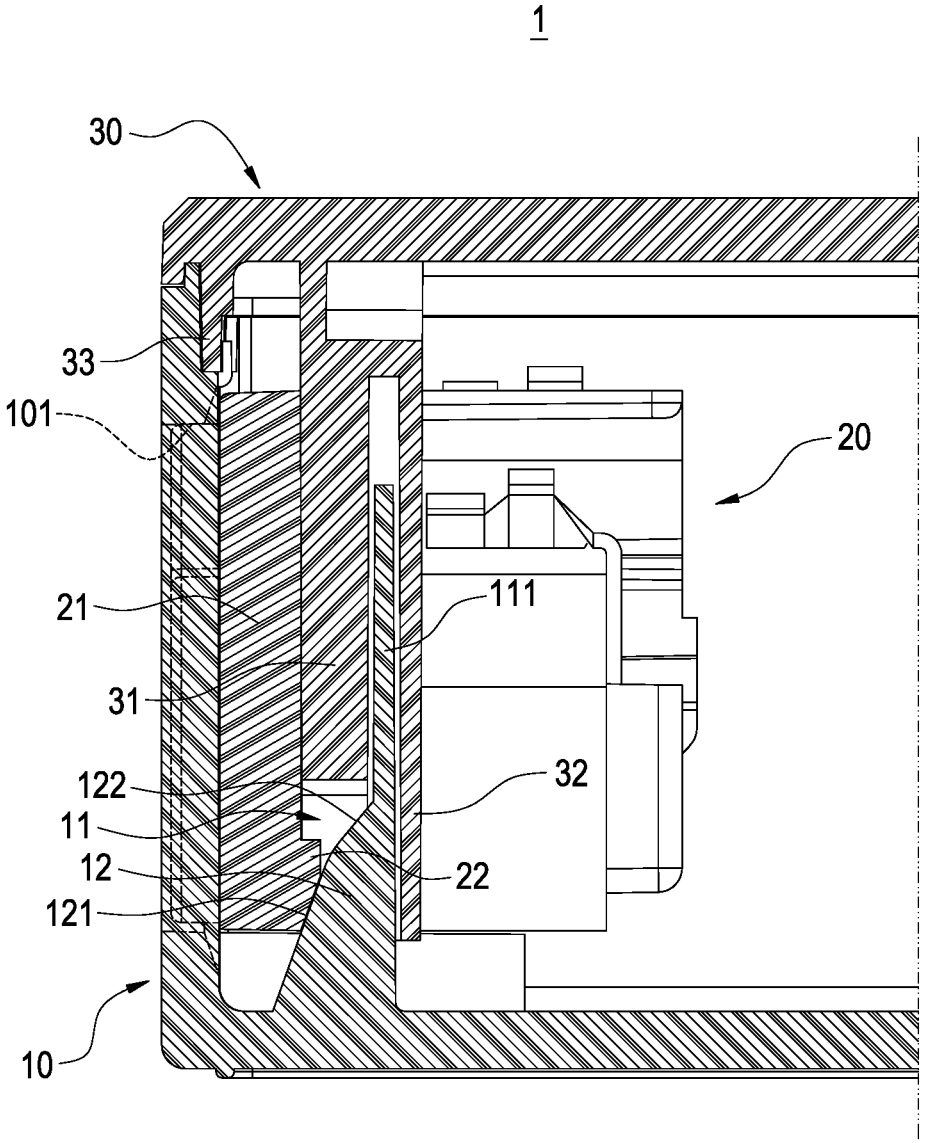
FIG. 8 and FIG. 9 are cross sectional views of two sides of the combination structure of socket of power supply device of the present invention.
Figure 9:
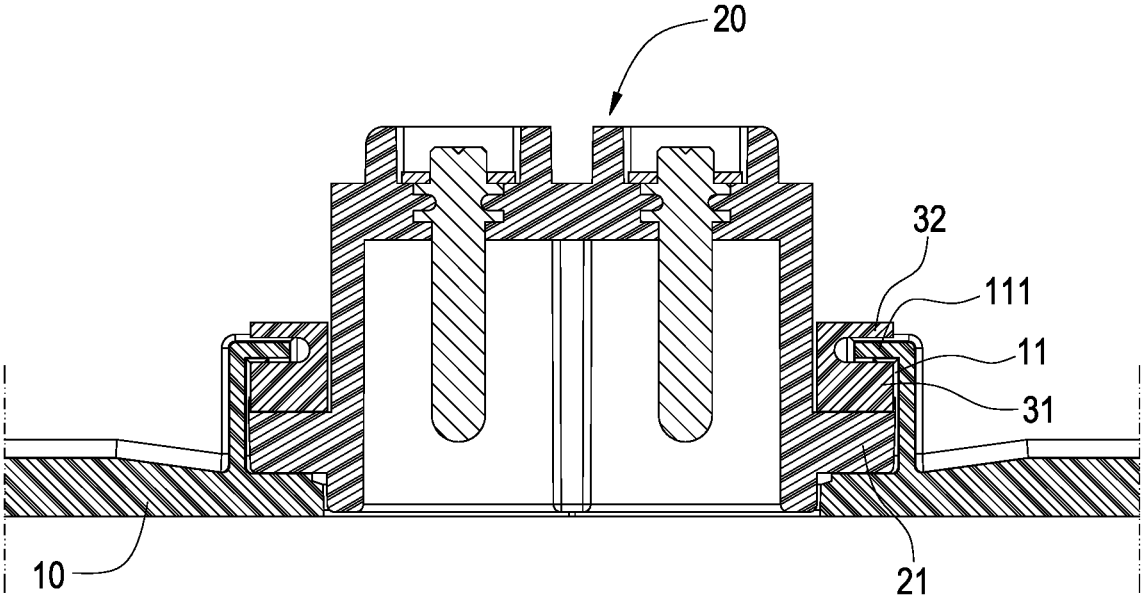

Please further refer to FIG. 8 and FIG. 9, which depict cross sectional views of two sides of the combination structure of socket of power supply device of the present invention. When the cover plate 30 covers the housing 10, the pair of clips 31 of the cover plate 30 are correspondingly inserted into the pair of sliding grooves 11 and abutted against the front plate 21 of the power socket 20. As a result, the power socket 20 is clamped between the cover plate 30 and the housing 10 without moving. In this embodiment, the pair of clips 31 are inserted between the front plate 21 of the power socket 20 and the stopper plate 111 of the housing 10.

It is worth noting that the supporting plate 32 of the cover plate 30 abuts against an outer side of the stopper plate 111, so that the stopper plate 111 will be supported when power socket 20 is subjected to an external force.

Although the present invention has been described with reference to the preferred embodiment thereof, it will be understood that the invention is not limited to the details thereof. Various substitutions and improvements have been suggested in the foregoing description, and others will occur to those of ordinary skill in the art. Therefore, all such substitutions and improvements are intended to be embraced within the scope of the invention as defined in the appended claims.

What is claimed is:

1. A combination structure of socket of power supply device, comprising:

a housing having an accommodation space and a socket opening communicated with the accommodation space; the housing formed with a pair of sliding grooves on two sides of the socket opening, and a guiding piece formed at a bottom of each of the sliding grooves; and the guiding piece including a positioning section connected with the housing and a guiding section extended from the positioning section;

a power socket passing through the pair of sliding grooves along the guiding section in the accommodation space, and one side of the power socket abutted against the positioning section so as to contact the socket opening; and a cover plate provided with a pair of clips on a side facing the housing corresponding to the sliding grooves, and the pair of clips correspondingly inserted into the pair of sliding grooves and abutted against a side of the power socket.

2. The combination structure of socket of power supply device according to claim 1, wherein the housing has a flange on an inner peripheral edge of the socket opening, and the flange is formed with a guiding slope so that the thickness of the flange becomes thinner from the inner peripheral edge of the socket opening outwardly.

3. The combination structure of socket of power supply device according to claim 1, wherein the positioning section and a normal of a bottom surface of the housing have a positioning oblique angle formed therebetween; the guiding section and the normal of the bottom surface of the housing have a guiding oblique angle formed therebetween; and the guiding oblique angle is greater than the positioning oblique angle.

4. The combination structure of socket of power supply device according to claim 1, wherein the power socket is provided with a guiding block, and the guiding block slides into the sliding grooves along the guiding piece and abuts on the positioning section.

5. The combination structure of socket of power supply device according to claim 4, wherein the power socket has a front plate, and the front plate is provided with the guiding block on a side facing the accommodation space corresponding to each of the guiding pieces; and the guiding block is located at a bottom side of the front plate.

6. The combination structure of socket of power supply device according to claim 1, wherein each of the sliding grooves is an L-shaped groove, and a stopper plate is formed on a side away from the socket opening.

7. The combination structure of socket of power supply device according to claim 6, wherein the guiding piece is vertically connected to one side of the stopper plate and located at a bottom of the stopper plate.

8. The combination structure of socket of power supply device according to claim 6, wherein the cover plate is provided with a supporting plate on a side of each of the clips, and the supporting plate is abutted against an outer side of the stopper plate.

9. The combination structure of socket of power supply device according to claim 8, wherein the clip and the supporting plate are connected and configured in an L shape.

10. The combination structure of socket of power supply device according to claim 1, wherein the cover plate has a combination wall, and a bump is formed at an end of the combination wall; a groove is provided on a top of the housing, and the combination wall is inserted in the groove; and the cover plate and the housing are bonded through melting the bump.

* * * * *